US007324067B2

(12) United States Patent
Shen

(10) Patent No.: US 7,324,067 B2
(45) Date of Patent: Jan. 29, 2008

(54) SATELLITE DISH ANTENNA ASSEMBLY

(76) Inventor: Wen-Chao Shen, No. 1000, Gwang Fu Road, Pa Teh City, Taoyuan County (TW)

( * ) Notice: Subject to any disclaimer, the term of this patent is extended or adjusted under 35 U.S.C. 154(b) by 0 days.

(21) Appl. No.: 11/370,060

(22) Filed: Mar. 8, 2006

(65) Prior Publication Data

US 2007/0210980 A1 Sep. 13, 2007

(51) Int. Cl.
*H01Q 15/14* (2006.01)

(52) U.S. Cl. ..... 343/912

(58) Field of Classification Search ..... 343/912, 343/760, 704, 702, 900, 790, 905
See application file for complete search history.

(56) References Cited

U.S. PATENT DOCUMENTS 5,617,107 A * 4/1997 Fleming ..... 343/704
5,734,356 A * 3/1998 Chang ..... 343/882
6,160,520 A * 12/2000 Muhlhauser et al. ..... 343/755
6,697,026 B1 * 2/2004 Hemmingsen, II ..... 343/760

* cited by examiner

*Primary Examiner*—Huedung Mancuso
(74) *Attorney, Agent, or Firm*—Rosenberg, Klein & Lee

(57) ABSTRACT

A satellite dish antenna assembly includes a dish surface, a convexly curved arc surface, a pair of corresponding protruding edges A, B disposed at the utmost front end of the two sides and serving as a base line $\overline{AB}$, such that upper and lower ends of the arc surface are extended from the two protruding edges along the dish to a level position of the base line $\overline{AB}$ to form an upper and a lower pulling surface coupled to the two protruding edges respectively, and a flange is installed at the periphery of the dish surface and its front side is substantially level, so as to overcome the shortcomings of the prior art antenna dish that may be deformed or warped easily when pressed and improve the life of the antenna and the accuracy of receiving signals.

5 Claims, 7 Drawing Sheets

SATELLITE DISH ANTENNA ASSEMBLY

BACKGROUND OF THE INVENTION

1. Field of the Invention

The invention relates to a satellite dish antenna assembly, and more particularly to a satellite dish antenna assembly having a pulling surface disposed between protruding edges for maintaining the edge of a disk in a plane and level position as well as preventing the disk from being warped or deformed.

2. Description of the Related Art

In the past, wireless communications on ground are usually affected by factors such as landforms and constructions, atmospheric layer, curvature of the earth, and electromagnetic field of the space, so that normal radio waves of communications are reflected, refracted and diffracted to give rise to poor communication effect and quality.

Thereafter, a communication satellite is introduced to overcome the shortcomings of traditional wireless communications, and an earth station including a dish antenna, a feedhorn, a low noise amplifier (LNA), a down converter, and a satellite is a major electronic means for receiving satellite signals, and thus radio wave signals transmitted by a satellite in a space orbit can be received effectively.

A dish antenna is a window for the whole earth station and its appearance looks like a dish, but its structure is actually in a parabolic shape for facilitating the focus of weak signals dispersed on the surface of the antenna, so that the front side of the antenna becomes a single focal point. Such focal point is usually used as a position for installing a feedhorn, and thus the quality and structural technology of an antenna is significant to the effect of receiving signals.

Satellite antennas are used for capturing signals from a satellite in the space and reflecting the signals to a unique focus, but the capability of capturing signals mainly depends on the precision of the curvature of the disk.

In general, the external diameter of a satellite antenna is below 0.9M, and thus is called a "Little Ear Antenna" which is mainly used in office or at home, and the satellite can be made by a whole piece of metal including but not limited to aluminum and stamped into the shape of a dish and its surface is coated with a reflective paint.

Referring to FIG. 1A for the schematic view of a prior art little ear antenna, a dish antenna 11 is fixed onto a stand 12, and a feedhorn 13 is installed at the front. Referring to FIGS. 1B to 1D for the side view, top view, and front view of the prior art dish antenna 11 respectively, the dish antenna 11 is a convexly curved arc body having two side edges 111 protruded from the edge surface as shown in FIG. 1C. When the dish antenna 11 is placed at a horizontal surface, only two contact points on the left and right sides are in touch with the horizontal surface, and the upper and lower ends 112 are in the shape of an arch, and thus the dish antenna 11 may be warped or turned easily, and the dish antennas 11 may be deformed easily, when they are stacked with each other or the backside 113 of the dish antenna 11 is pressed. As a result, the life of the antenna will be affected. Since the entire curvature of the dish surface will be affected if the dish is not placed in a level, therefore a poor signal receipt will be resulted. The present invention intends to such problem.

Referring to FIG. 2A for the enlarged view of a flange 114 of a prior art dish antenna 11, the flange 114 includes a cut-resisting function and also improves the intensity of the dish body. However, the manufactured antenna will be shipped and transported by containers, and it is necessary to stack the antenna as shown in FIG. 2B. If the dish antenna 11*b* at the top is stacked on the dish antenna 11*a* at the bottom, the front side 115 of the dish edge of the dish antenna 11*b* at the top will be disposed over the flange 114 of the antenna 11*a* at the bottom. Such arrangement not only occupies a larger stacking height, but also causes a risk for the dish antenna 11*b* at the top to fall out due to the smooth surface of the dish antenna as indicated by the imaginary line in the figure, and thus the antenna may be toppled or damaged.

SUMMARY OF THE INVENTION

In view of the shortcomings of the prior art satellite antenna, the inventor of the present invention based on years of experience to conduct extensive researches and experiments to overcome the foregoing shortcomings, and finally invented a satellite dish antenna assembly in accordance with the present invention.

Therefore, it is a primary object of the invention to provide a satellite dish antenna assembly that uses a pulling surface extended from both sides when the assembly is stamped and formed to reinforce the mechanical strength of its curved surface, so that the dish body will not be deformed or warped easily, so as to improve the life of the antenna and the accuracy of receiving signals.

Another object of the present invention is to provide a satellite dish antenna assembly that uses the design of a concave dish edge to form a circular groove, so that when the dish antennas are stacked, the flange around the satellite antenna at the bottom is contained in the circular groove, so as to secure the stacked structure and save the stacking space as well as preventing the antenna from falling out or being damaged.

In order to reach the above-mentioned objects, the invention includes:

a dish surface, having a convexly curved arc surface, and a pair of corresponding protruding edges A, B defined on the utmost front end of both sides of the dish surface and serving as a base line $\overline{AB}$, such that upper and lower ends of the arc surface are extended from the two protruding edges along the dish to a level position of the base line $\overline{AB}$ to form an upper and a lower pulling surfaces of the two flange respectively; and a flange, disposed at the periphery of the dish surface and having a front side with a substantially level height.

Based upon the above-mentioned configuration, the flange further comprises an inwardly concave circular groove disposed at the front side of the flange, and a curly folded body disposed at the backside of the flange.

In this way, the invention provides a protection against deformation and ensures a stable stack.

BRIEF DESCRIPTION OF THE FIGS.

Figure 1A:
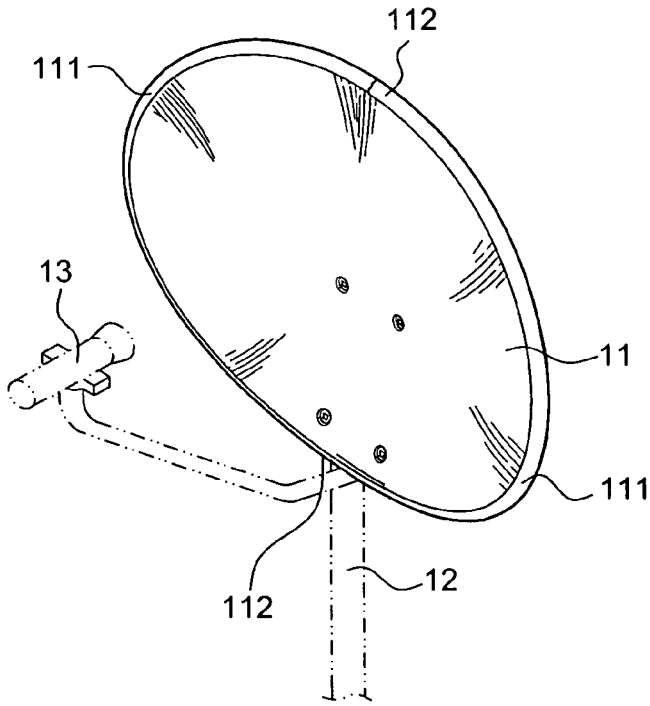
FIG.1(A) PRIOR ART
FIGS. 1A to 1D are perspective view, side view, top view, and front view of a prior art satellite antenna respectively.
Figure 1B:
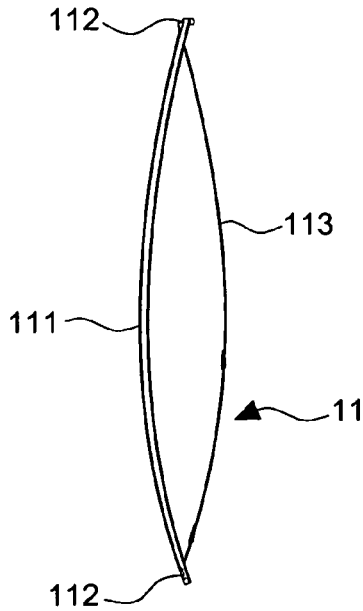
FIG.1(B) PRIOR ART
Figure 1C:
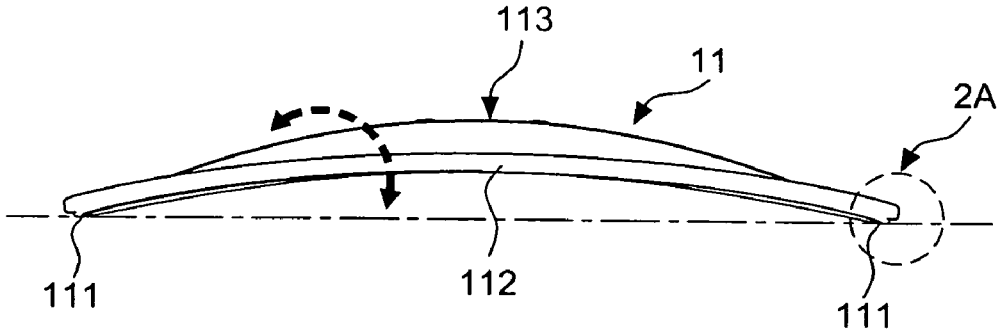
FIG.1(C) PRIOR ART
Figure 1D:
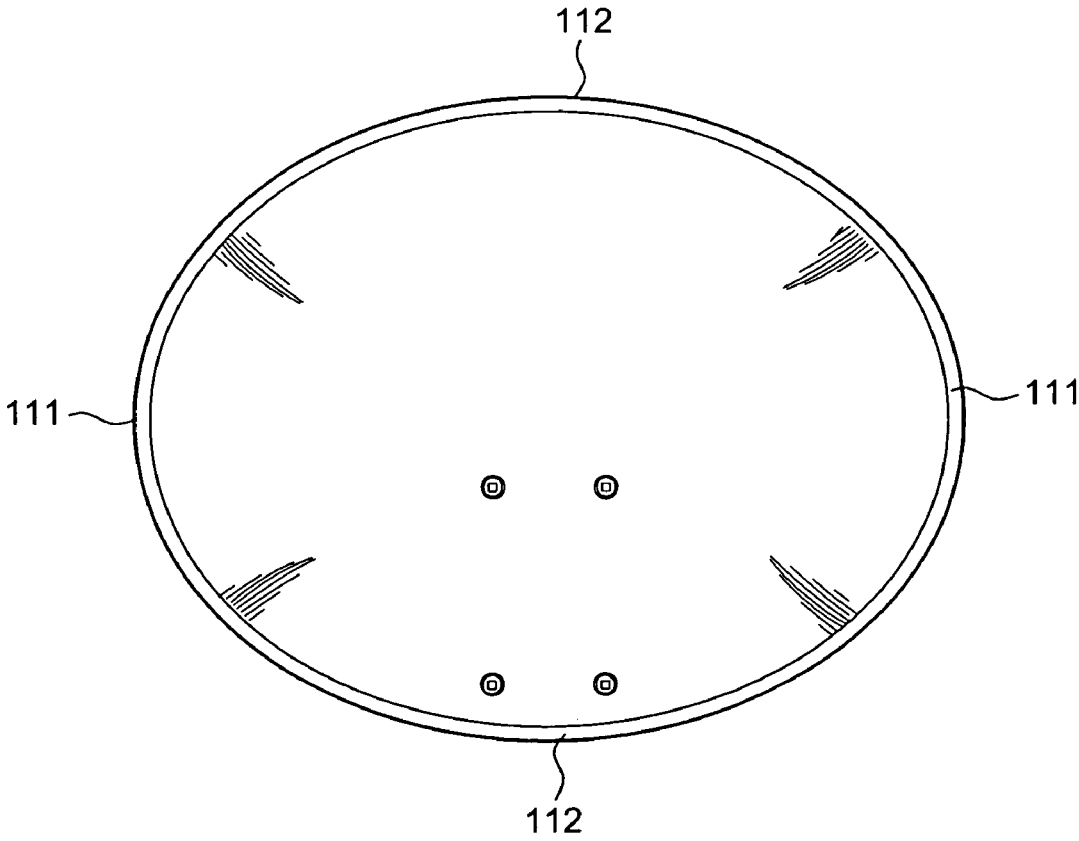
FIG.1(D) PRIOR ART
Figure 2A:
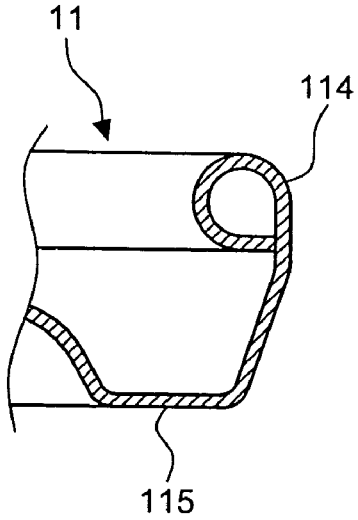
FIG.2(A) PRIOR ART
FIG. 2A is an enlarged view of Section 2A as depicted in FIG. 1C.
Figure 2B:
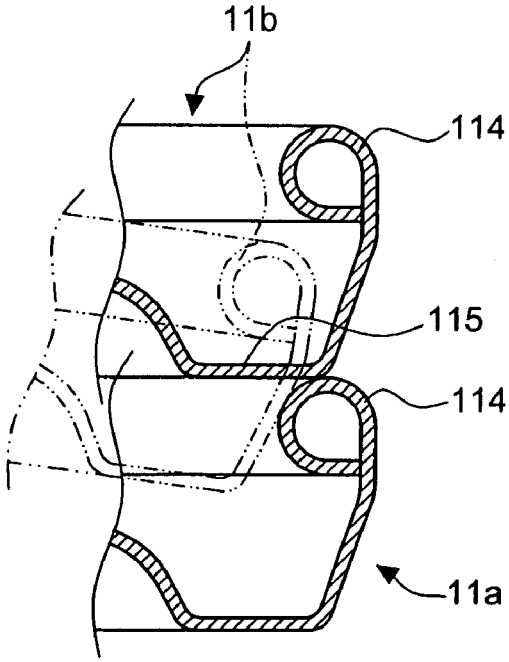
FIG.2(B) PRIOR ART
FIG. 2B is a schematic view of stacking prior art satellite antennas.
Figure 3A:
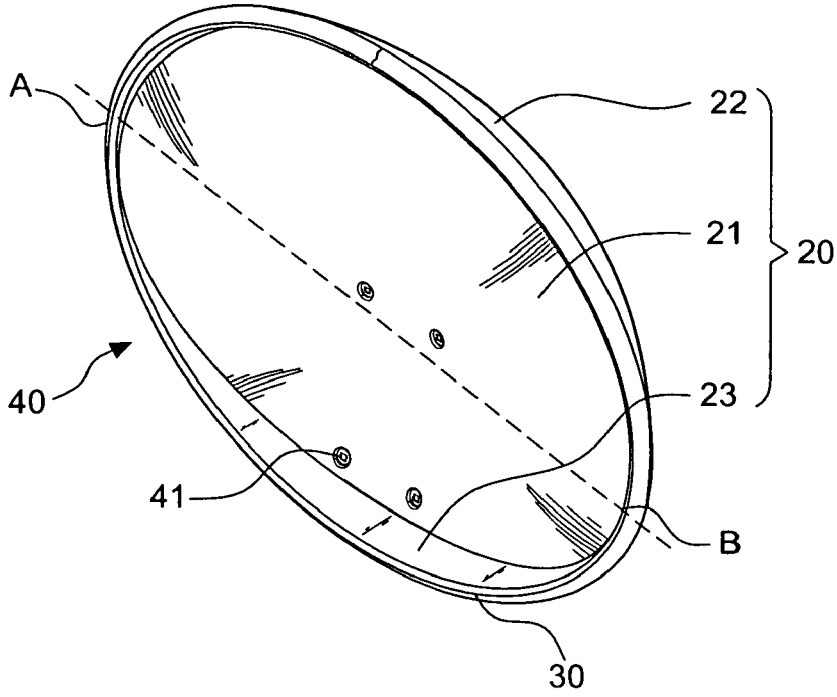
FIG. 3A is a perspective view of the present invention.
Figure 3B:
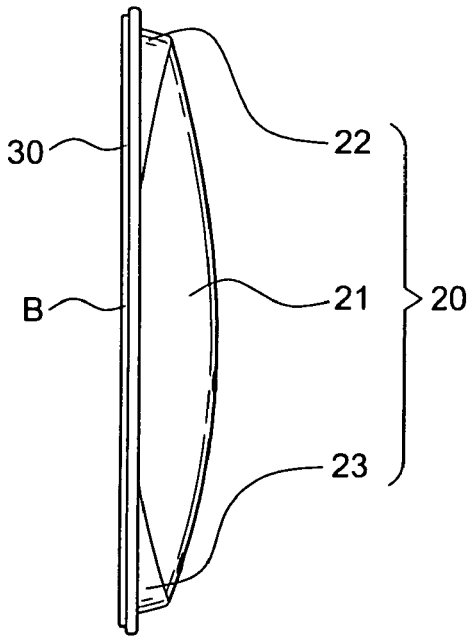
FIG. 3B is a side view of the present invention.
Figure 3C:
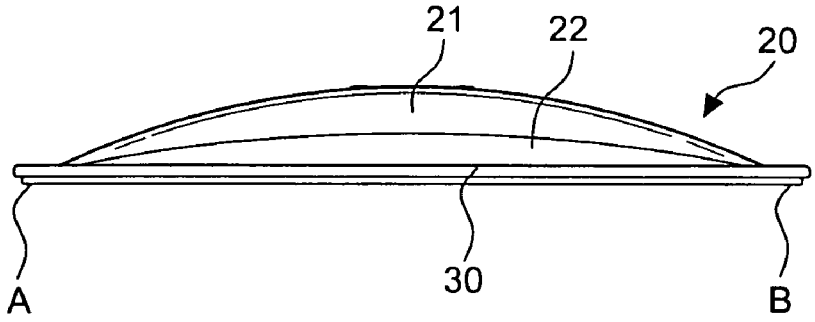
Figure 3D:
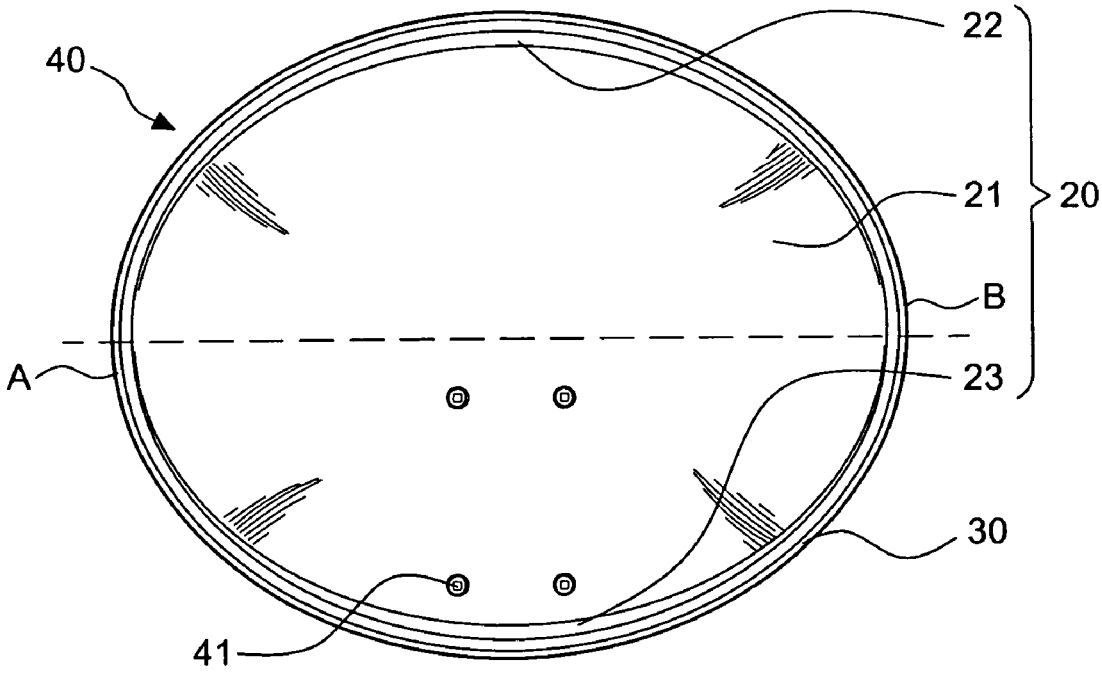
Figure 4:
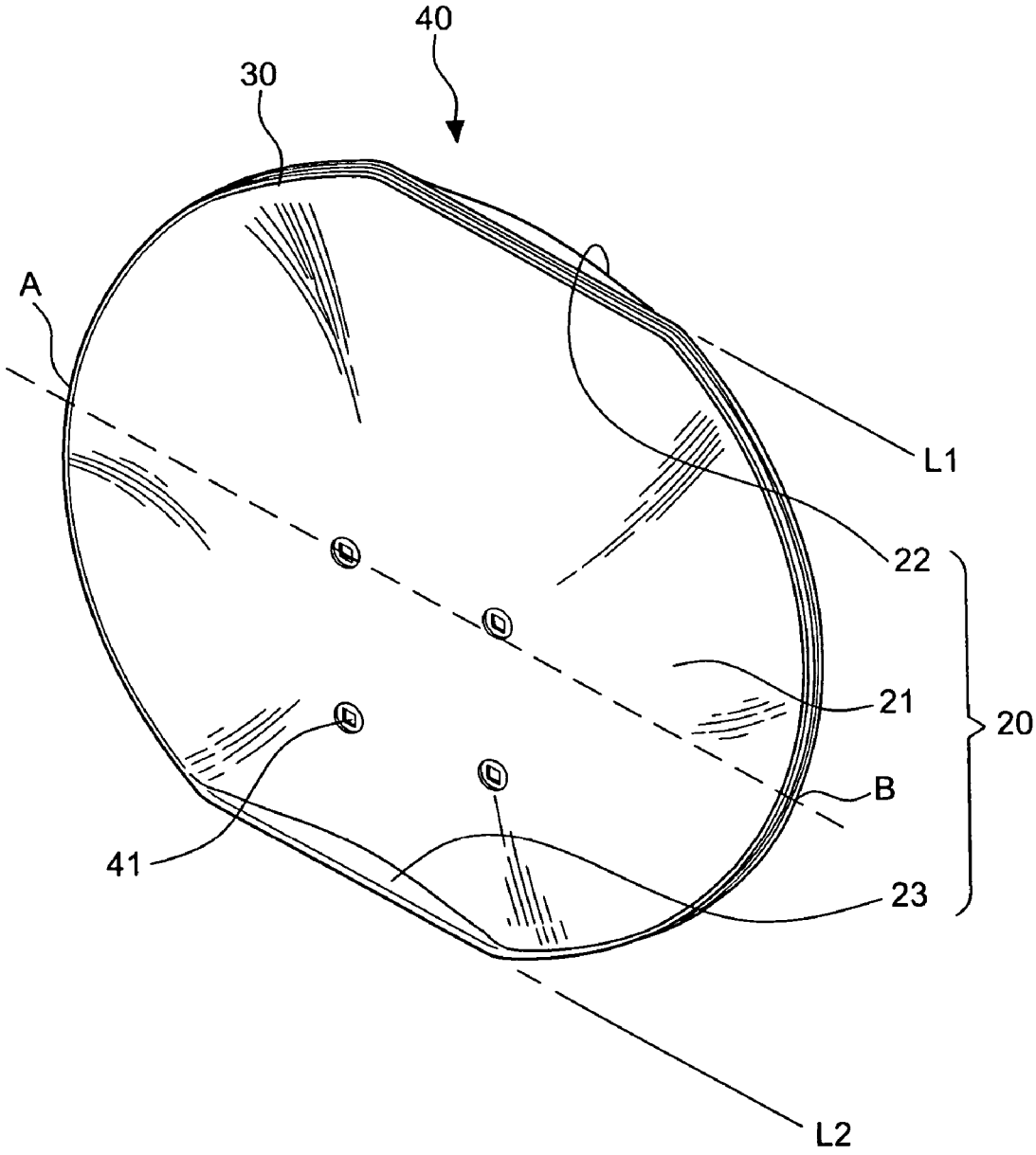
Figure 5:
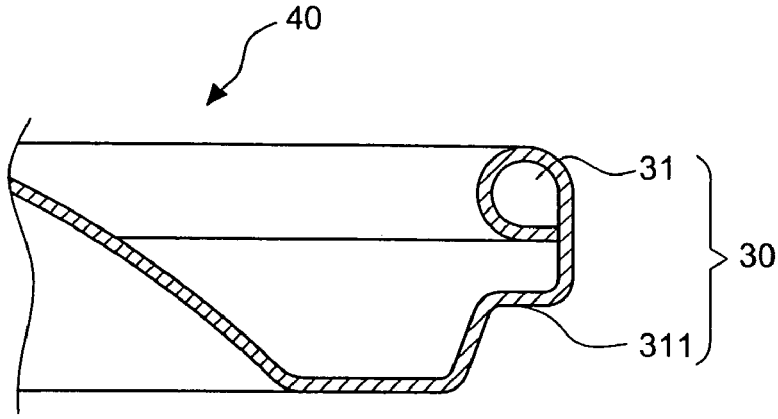
Figure 6:
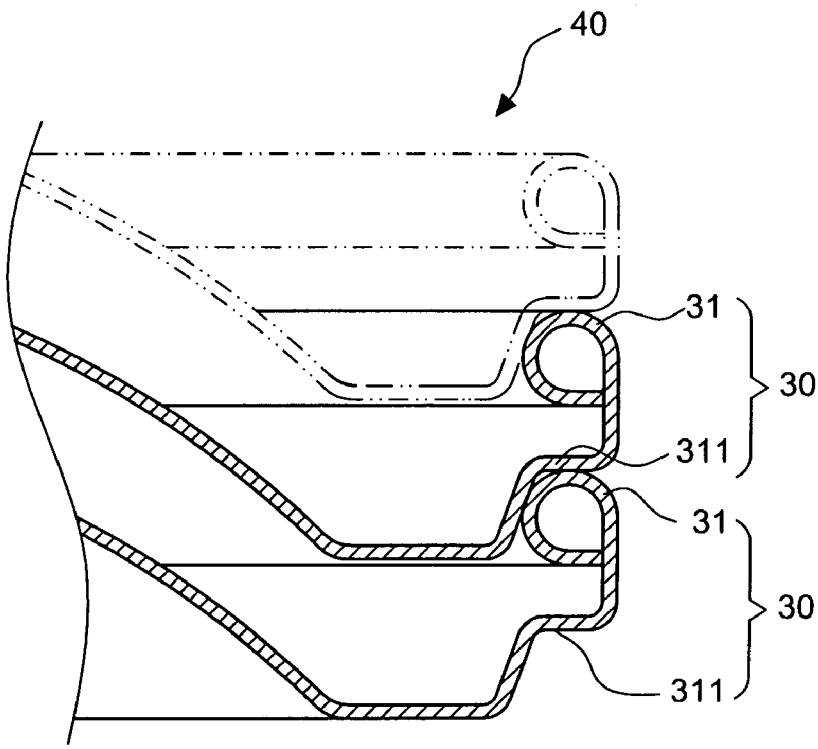

FIG. 3 C is a top view of the present invention;

FIG. 3D is a front view of the present invention;

FIG. 4 is a perspective view of another preferred embodiment of the present invention;

FIG. 5 is an enlarged view of a flange structure of the present invention; and FIG. 6 is a view of stacking state of the present invention.

DETAILED DESCRIPTION OF THE PREFERRED EMBODIMENT

Referring to FIGS. 3A to 3D for the perspective view, side view, top view, and front view of a satellite antenna dish body 40 of the present invention respectively, the satellite antenna dish body 40 comprises a dish surface 20 and a flange 30 disposed around the periphery of the dish surface 20.

The dish surface 20 includes a convexly curved arc surface 21, a pair of corresponding protruding edges A, B disposed on both sides of the utmost front end of the dish surface 20 and serving as a base line $\overline{AB}$, such that the upper and lower ends of the arc surface 21 are extended from the two protruding edges A, B along the dish shape to a plane of the base line $\overline{AB}$ to connect the upper and lower pulling surfaces 22, 23 to the two protruding edges, and a flange 30 is disposed around the periphery of the dish surface 20, and its front side has a level height.

With the foregoing technical measure, we can compare the difference of the present invention with the prior art dish antenna 11. Firstly, the present invention uses integrally formed upper and lower pulling surfaces 22, 23 to exert a pulling force on both sides of an originally open convexly curved arc surface 21 as shown in FIG. 3C, such that its backside is pressed and the two protruding edges A, B will not be propped outward. Further, the upper and lower pulling surfaces 22, 23 are extended to a level position of the protruding edges A, B on both sides, so that when the antenna is placed on the ground or a tabletop, the entire front side of the flange 30 of the dish body 40 is attached. Unlike the prior art that only the left and right sides are supported, the present invention will not be warped, turned, or deformed easily, and thus can improve the life of the antenna and maintain a good curvature of the dish surface 21, so as to achieve the effect of accurately receiving satellite signals.

The convexly curved arc surface 21 of the invention is elliptical, but not limited to such shape only, and the upper and lower pulling surfaces 22, 23 are matched with the dish shape and extended to the front of the arc surface 21.

Referring to FIG. 4 for another preferred embodiment of the present invention, the same structure are represented by the same numbers and its difference with the previous preferred embodiment resides on that the convexly curved arc surface 21 is non-elliptical, and its upper and lower ends are flat and straight. In other words, L1 is parallel to L2, and the upper and lower pulling surfaces 22, 23 are matched with the flat and straight shape of the upper and lower ends and extended to the front of the arc surface 21 to achieve the same effect of the previous preferred embodiment. Besides the aforementioned shape, the dish body could be made according to actual needs, and such modification will not be described here.

Referring to FIGS. 5 and 6, the flange 30 further comprises an inwardly concave circular groove 311 disposed at the front side of the flange 30, such that when a plurality of dish bodies 40 are stacked, the folded body 31 at the bottom will press against the circular groove 311 at the top, so as to secure the stacked structure, save spaces, and prevent the antennas from falling out or being damaged.

The dish surface 20 and the flange 30 of the dish body 40 according to this preferred embodiment are integrally stamped and made of metal, which is preferably aluminum or an equivalent material. The dish surface 20 includes a plurality of connecting holes 41 disposed at the middle of the dish surface 20 for fixing a stand (not shown in the figure).

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A satellite dish antenna assembly, comprising: a dish surface, having a convexly curved arc surface, and a pair of corresponding protruding edges A, B defined on the utmost front end of both sides of the dish surface and serving as a base line $\overline{AB}$, such that upper and lower ends of the arc surface are extended from the two protruding edges along the dish to a level position of the base line $\overline{AB}$ to form an upper and a lower pulling surfaces of the two flanges respectively, wherein the convexly curved arc surface is non-elliptical, and the upper and lower ends are flat and straight. and the upper and lower pulling surfaces are matched with the shape of the arc surface and extended to the front of the arc surface; and a flange, disposed at the periphery of the dish surface and having a front side with a substantially level height.

2. The satellite dish antenna assembly as recited in claim 1, wherein the convexly curved arc surface is elliptical, and the upper and lower pulling surfaces are matched with the shape of the arc surface and extended to the front of the arc surface.

3. The satellite dish antenna assembly as recited in claim 1, wherein the dish surface and the flange are integrally stamped and formed of metal.

4. The satellite dish antenna assembly as recited in claim 1, wherein the dish surface includes a plurality of connecting holes disposed at the middle of the dish surface.

5. A satellite dish antenna assembly, comprising:

a dish surface, having a convexly curved arc surface, and a pair of corresponding protruding edges A, B defined on the utmost front end of both sides of the dish surface and serving as a base line $\overline{AB}$, such that upper and lower ends of the arc surface are extended from the two protruding edges along the dish to a level position of the base line $\overline{AB}$ to form an upper and a lower pulling surface of the two flanges respectively; and a flange, disposed at the periphery of the dish surface and having a front side with a substantially level height, the flange including an inwardly concave circular groove disposed at the front side of the flange, and a curly folded body disposed at the backside of the flange.

* * * * *